US007789714B2

(12) United States Patent
Liu

(10) Patent No.: US 7,789,714 B2
(45) Date of Patent: Sep. 7, 2010

(54) CONNECTOR ASSEMBLY

(75) Inventor: Jen-Yee Liu, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/248,901

(22) Filed: Oct. 10, 2008

(65) Prior Publication Data

US 2009/0298324 A1 Dec. 3, 2009

(30) Foreign Application Priority Data

May 28, 2008 (CN) ..... 2008 1 0301803

(51) Int. Cl.
*H01R 13/00* (2006.01)

(52) U.S. Cl. ..... 439/682; 439/692; 439/924.1

(58) Field of Classification Search ..... 439/660, 439/682, 692, 924.1, 924.2
See application file for complete search history.

(56) References Cited

U.S. PATENT DOCUMENTS

| | | | | | |
|---|---|---|---|---|---|
| 4,084,875 | A * | 4/1978 | Yamamoto | 439/274 |
| 5,176,528 | A * | 1/1993 | Fry et al. | 439/181 |
| 5,591,035 | A * | 1/1997 | Burkholder et al. | 439/79 |
| 5,909,065 | A * | 6/1999 | Jones et al. | 307/147 |
| 6,056,573 | A * | 5/2000 | Nishioka | 439/326 |
| 6,494,734 | B1 * | 12/2002 | Shuey | 439/378 |
| RE39,855 | E * | 9/2007 | Wong | 307/140 |
| 7,300,313 | B1 * | 11/2007 | Whiteman et al. | 439/680 |

* cited by examiner

*Primary Examiner*—Xuong M Chung-Trans
(74) *Attorney, Agent, or Firm*—Zhigang Ma

(57) ABSTRACT

A connector includes a base defining a plurality of holes, and a plurality of pins inserted into the corresponding holes. The pins include a ground pin, a voltage signal pin, and a power-on signal pin. Wherein the length of the ground pin extending into a corresponding hole is longer than that of the voltage signal pin, while the length of the voltage signal pin is longer than that of the power-on signal pin.

7 Claims, 4 Drawing Sheets

CONNECTOR ASSEMBLY

BACKGROUND

1. Field of the Invention

The present invention relates to connectors and, more particularly, to a connector assembly used in an electronic device.

2. Description of Related Art

A connector is generally used to connect two electronic devices to transmit signals between the electronic devices, or to connect an electronic device with a power supply to supply power for the electronic device.

In testing a motherboard of an electronic device, a connector of a power supply is firstly insert into a connector of the motherboard to supply power for the motherboard to be tested, and then is removed from the connector of the motherboard after the motherboard has been tested. During mass production, all the motherboards have to be tested. Thus, the connector needs to be inserted into and removed from the connectors of the motherboards repeatedly. Typically, the aforementioned operations are always performed when the motherboard is power-on, as well as hot-plugging. However, during the aforementioned operations, the order of contacting between each pair of pins of the connector is difficult to control, which leads to disorganized signals.

What is desired, therefore, is a connector assembly which avoids unordered contact between pins of a male connector and pins of a female connector.

DETAILED DESCRIPTION

A connector assembly of the present invention includes a male connector and a female connector. Length of pins of the male connector is not equal to that of the female connector.

Figure 1:
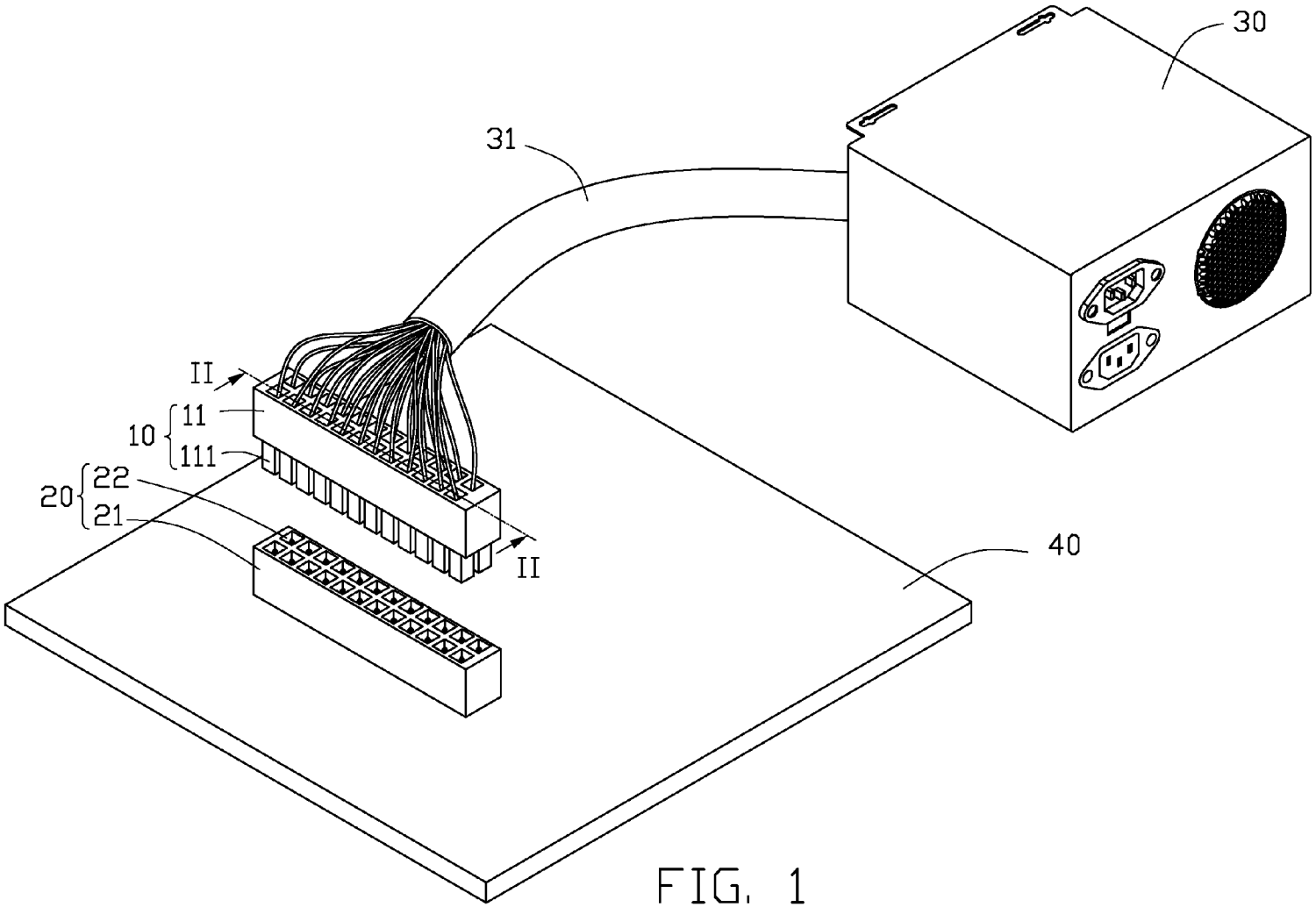
FIG. 1 is an isometric view of a first embodiment of a connector assembly, together with a power supply and a motherboard.
Figure 2:
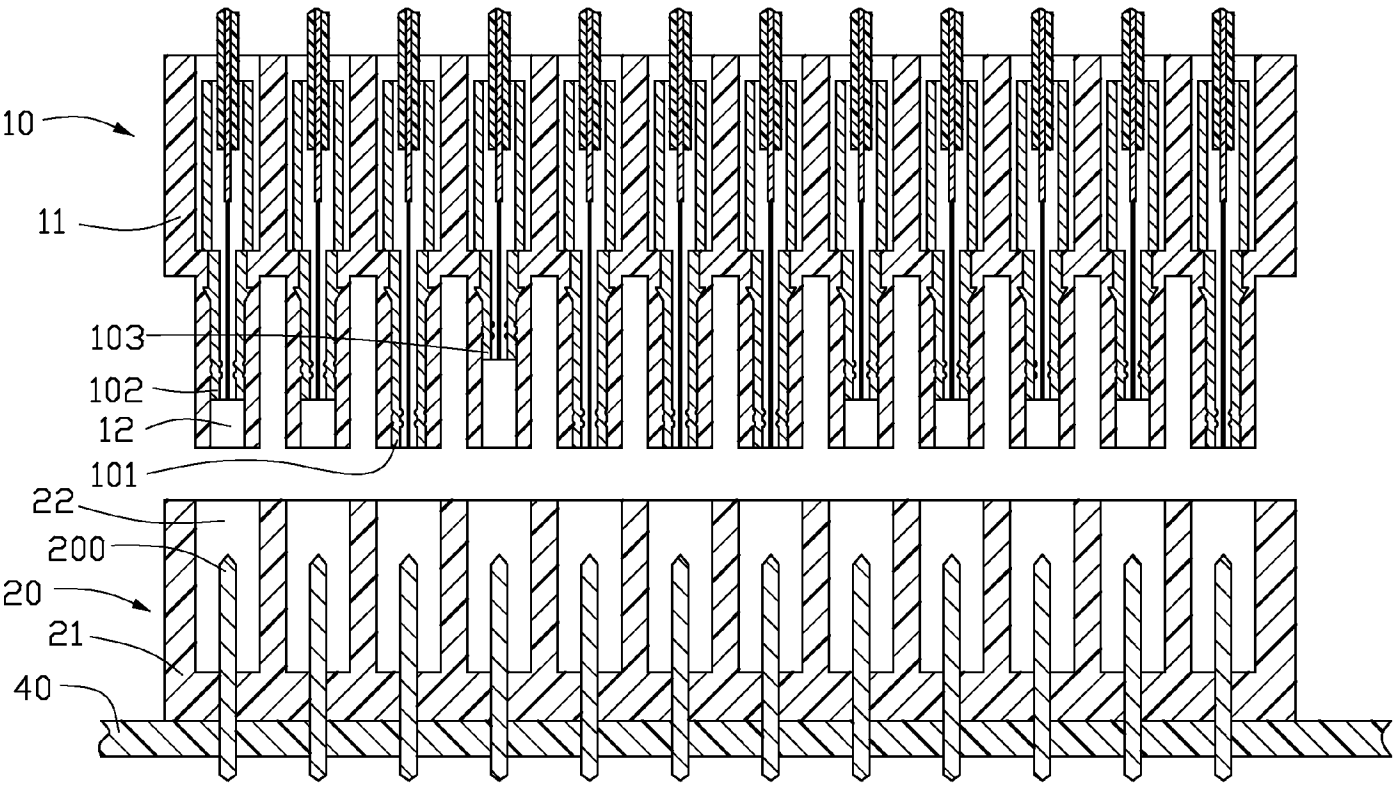
FIG. 2 is a cross-sectional view of the connector assembly taken along the line II-II of FIG. 1.

Referring to FIGS. 1 and 2, in a first embodiment, a connector assembly includes a male connector 10 and a female connector 20 mating with the male connector 10. The male connector 10 is electrically connected to a power supply 30 via cables 31. The female connector 20 is electrically connected to a motherboard 40.

The male connector 10 includes a base 11, and a plurality of pegs 111 extending from a lower surface of the base 11. The male connector 11 defines a plurality of through holes 12 extending from the base 11 through the pegs 111. Each of the through holes 12 receives one of the pins of the male connector 11. The pins received in all the through holes 12 include a plurality of ground pins 101, a plurality of voltage signal pins 102, and a power-on signal pin 103. The length of each ground pin 101 extending into the corresponding peg 111 is longer than that of each of the voltage signal pins 102, and the length of each voltage signal pin 102 extending into the corresponding peg 111 is longer than that of the power-on signal pin 103. The ground pins 101, the voltage signal pins 102, and the power-on signal pin 103 are electrically connected to the power supply 30 via the cables 31.

The female connector 20 includes a base 21 mounted to the motherboard 40. The base 21 defines a plurality of holes 22, corresponding to the pegs 111. Each of the holes 22 receives a pin 200. One end of each of the pins 200 is electrically connected to the motherboard 40, and the other end of each of the pins 200 extends into a corresponding hole 22. The pins 200 extending into the corresponding holes 22 have the same length.

In use, the male connector 10 is inserted into the female connector 20. Because the ground pins 101 are the longest, they contact with the corresponding pins 200 of the female connector 20 first. The voltage signal pins 102 contact with the corresponding pins 200 of the female connector 20 afterwards. The power-on signal pin 103 is the shortest, thus it contacts with the corresponding pin 200 of the female connector 20 the last. Therefore, the signals respectively transmitted by the ground pins 101, the voltage signal pins 102 and the power-on signal pin 103 are transmitted to the corresponding pins 200 of the female connector 20 in an order determined by the lengths of the pins of the male connector 10, thus preventing disorganized signals caused by the unordered contact between the pins of the male and female connectors 10, 20.

Figure 3:
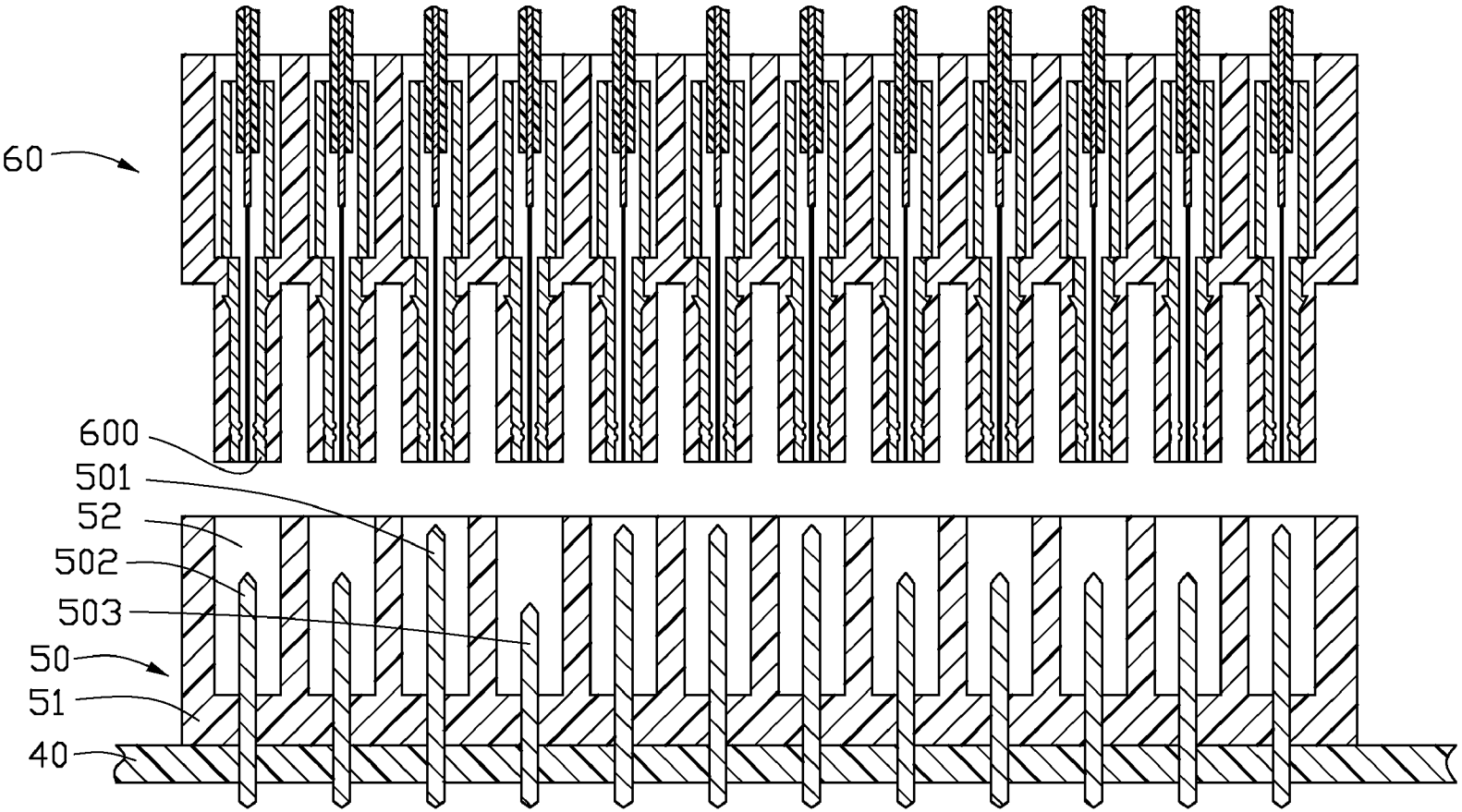
FIG. 3 is a cross-sectional view of a connector assembly of a second embodiment.

Referring also to FIG. 3, as a second embodiment, a connector assembly includes a female connector 50 and a male connector 60 mating with the female connector 50. The male connector 60 defines a plurality of through holes for receiving a plurality of pins 600. The pins 600 extending into the through holes have a same length. The female connector 50 includes a base 51 mounted to the motherboard 40. The base 51 defines a plurality of holes 52. Each of the holes 52 receives one pin. One end of each of the pins is electrically connected to the motherboard 40, and the other end of each of the pins extends into a corresponding hole 52. The pins of the female connector 50 include a plurality of ground pins 501, a plurality of voltage signal pins 502, and a power-on signal pin 503. The length of each ground pin 501 extending into the corresponding hole 52 is longer than that of each voltage signal pin 502, however the length of each voltage signal pin 502 is longer than that of the power-on signal pin 503.

In use, the male connector 60 is inserted into the female connector 50. Because the ground pins 501 are longest, they contact with the corresponding pins 600 of the male connector 60 first. The voltage signal pins 502 contact with the corresponding pins 600 afterwards. The power-on signal pin 503 is shortest, thereby it contacts with the corresponding pin 600 of the male connector 60 last. Therefore, the signals respectively transmitted by the ground pins 501, the voltage signal pins 502, and the power-on signal pin 503 are sent to the corresponding pins 600 of the male connector 60 according to the lengths of the pins, thus preventing disorganized signals caused by the unordered contact between the pins of the male and female connectors 50, 60.

Figure 4:
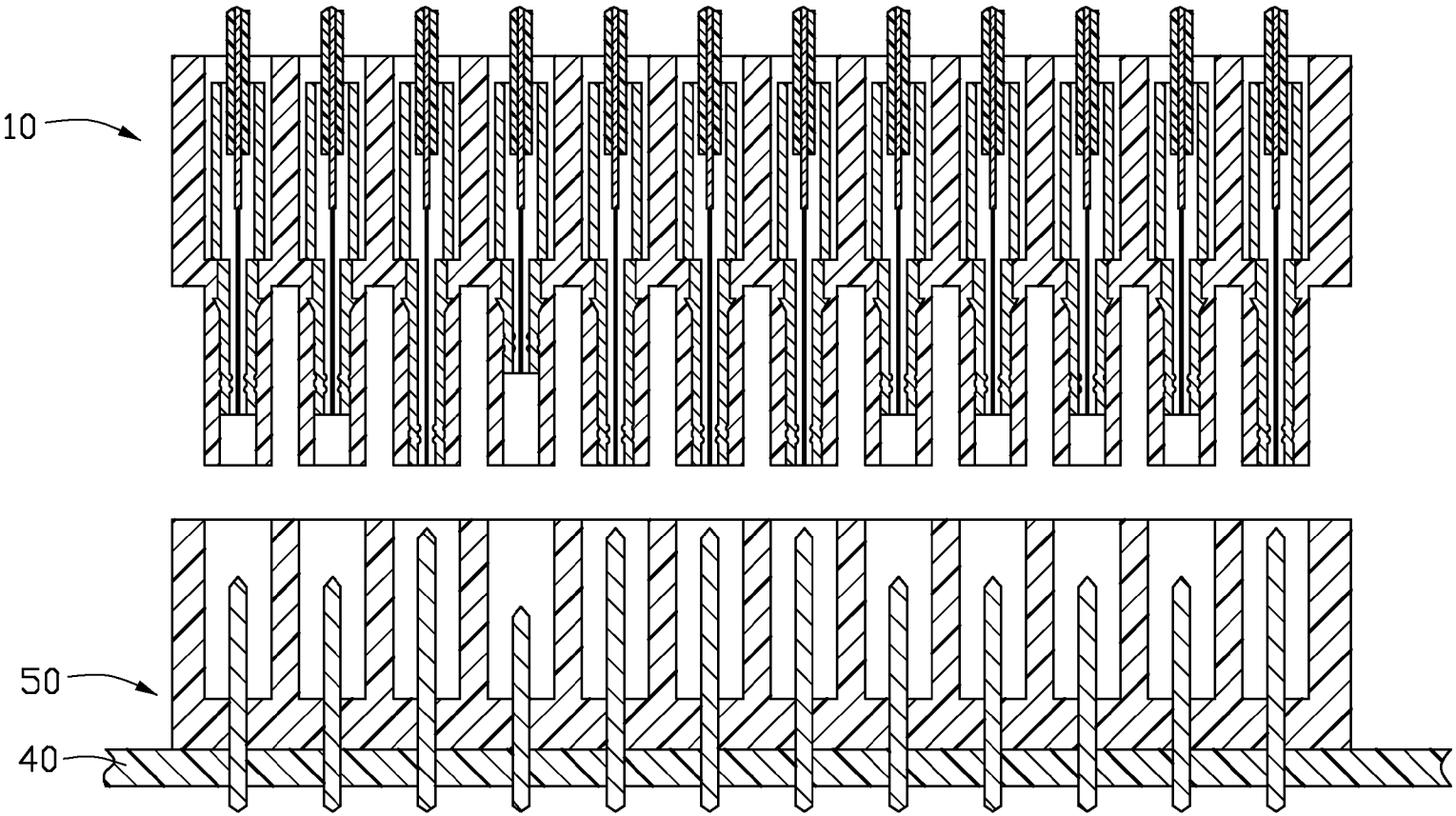
FIG. 4 is a cross-sectional view of a connector assembly of a third embodiment.

Referring to FIG. 4, as a third embodiment, a connector assembly includes the male connector 10 of the first embodiment and the female connector 50 of the second embodiment mating with the male connector 10. Obviously, the connector assembly of the third embodiment is capable to achieve the same effect of the first and second embodiments.

It is also to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector is provided to connect a power supply unit to a motherboard for testing the motherboard in a hot-plugging state, the connector comprising:

a base defining a plurality of holes; and a plurality of pins inserted into the corresponding holes, comprising a ground pin, a voltage signal pin, and a power-on signal pin;

wherein the length of the ground pin extending into a corresponding hole is longer than that of the voltage signal pin, while the length of the voltage signal pin is longer than that of the power-on signal pin;

wherein when the connector is inserted into motherboard, the ground pin contacts with motherboard first, the voltage signal pin contacts with the motherboard afterwards, the power-on signal pin contacts with the motherboard last, therefore the signals respectively transmitted by the ground pin, the voltage signal pin, and the power-on signal pin are sent to the motherboard.

2. The connector of claim 1, wherein the connector is a male connector, configured to be electrically connected to one end of a cable.

3. The connector of claim 2, wherein the connector is a female connector, configured to be electrically connected to one motherboard.

4. A connector assembly is provided to connect a power supply unit to a motherboard for testing the motherboard in a hot-plugging state, the connector assembly comprising:

a female connector mounted on the motherboard and defining a plurality of first holes, the plurality of first holes receiving a plurality of first pins; and a male connector electrically connected with the power supply unit and defining a plurality of second holes, the plurality of second holes receiving a plurality of second pins mating with the corresponding first pins, the plurality of second pins comprising a ground pin, a voltage signal pin, and a power-on signal pin;

wherein the length of the ground pin extending into the corresponding second hole is longer than that of the voltage signal pin, while the length of the voltage signal pin extending into the corresponding second hole is longer than that of the power-on signal pin;

wherein when the male connector is inserted into the female connector of the motherboard, the ground pin contacts with motherboard first, the voltage signal pin contacts with the motherboard afterwards, the power-on signal pin contacts with the motherboard last, therefore the signals respectively transmitted by the ground pin, the voltage signal pin, and the power-on signal pin are sent to the motherboard.

5. A connector assembly is provided to connect a power supply unit to a motherboard for testing the motherboard in a hot-plugging state, the connector assembly comprising:

a female connector defining a plurality of first holes for receiving a plurality of first pins; the first pins comprising a first ground pin, a first voltage signal pin, and a first power-on signal pin; the length of the first ground pin extending into a corresponding first hole is longer than that of the first voltage signal pin, while the length of the first voltage signal pin extending into a corresponding first hole is longer than that of the first power-on signal pin; and a male connector defining a plurality of second holes for receiving a plurality of second pins mating with the corresponding first pins of the female connector; the second pins comprising a second ground pin, a second voltage signal pin, and a second power-on signal pin; the length of the second ground pin extending into a corresponding second hole is longer than that of the second voltage signal pin, while the length of the second voltage signal pin is longer than that of the second power-on signal pin;

wherein when the male connector is inserted into the female connector of the motherboard, the first ground pin of the female connector contacts with the second ground pin of the male connector first, the first voltage signal pin of the female connector contacts with the second voltage signal pin of the male connector afterwards, the first power-on signal pin of the female connector contacts with the second power-on signal pin of the male connector last, therefore the signals respectively transmitted by the first and second ground pins, the first and second voltage signal pins, and the first and second power-on signal pins are sent from power supply unit to the motherboard.

6. The connector assembly of claim 5, wherein the male connector is configured to be electrically connected to one end of a cable of a power supply.

7. The connector assembly of claim 5, wherein the female connector is configured to be electrically connected to one motherboard.

* * * * *